US007504919B1

(12) United States Patent
Tittle

(10) Patent No.: US 7,504,919 B1
(45) Date of Patent: Mar. 17, 2009

(54) WATER RESISTANT SWITCH ASSEMBLY

(75) Inventor: Michael D. Tittle, Harbor City, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 143 days.

(21) Appl. No.: 11/351,557

(22) Filed: Feb. 10, 2006

Related U.S. Application Data

(60) Provisional application No. 60/651,586, filed on Feb. 10, 2005.

(51) Int. Cl.
*H01H 9/00* (2006.01)
*H01H 1/66* (2006.01)
*H01H 51/00* (2006.01)

(52) U.S. Cl. ..... 335/207; 335/151

(58) Field of Classification Search ..... 335/151–153, 335/205–207
See application file for complete search history.

(56) References Cited

U.S. PATENT DOCUMENTS

| | | | | |
|---|---|---|---|---|
| 2,966,561 | A | 12/1960 | Durant | |
| 3,445,796 | A | 5/1969 | Spiroch et al. | |
| 3,463,491 | A | 8/1969 | Shaw | |
| 3,510,069 | A | 5/1970 | Hannum | |
| 3,668,579 | A | 6/1972 | Harman | |
| 3,760,312 | A | 9/1973 | Shlesinger, Jr. | |
| 3,790,912 | A * | 2/1974 | Murphy | 335/205 |
| 3,974,469 | A | 8/1976 | Nicholls | |
| 3,993,885 | A | 11/1976 | Kominami et al. | |
| 4,041,427 | A * | 8/1977 | Chusha | 335/205 |
| 4,152,755 | A * | 5/1979 | Trosper et al. | 362/158 |
| 5,629,659 | A | 5/1997 | Steiner | |
| 5,999,072 | A * | 12/1999 | Slavik | 335/207 |
| 6,016,020 | A | 1/2000 | Cline et al. | |
| 6,635,838 | B1 * | 10/2003 | Kornelson | 200/341 |
| 6,636,135 | B1 | 10/2003 | Vetter | |
| 6,729,016 | B2 | 5/2004 | Wieger et al. | |
| 7,256,671 | B1 * | 8/2007 | Preaux | 335/207 |

OTHER PUBLICATIONS

Judco Manufacturing drawings (redacted) of prior switch assembly on sale at least as early as 2002, (4 sheets).

* cited by examiner

*Primary Examiner*—Elvin G Enad
*Assistant Examiner*—Bernard Rojas
(74) *Attorney, Agent, or Firm*—Michael Zarrabian, Esq.; Myers Dawes Andras & Sherman, LLP

(57) ABSTRACT

A water resistant switch assembly as a housing and cover. A reed switch is in the housing is connected to electrical wires extending out of the housing through an elastomeric grommet that seals to the housing. A plunger is mounted for longitudinal movement in the housing and supports a magnet which can move closer to the reed switch in one direction of motion and further away from the reed switch in the opposite direction. An elastomeric boot is between the housing and cover and also over the end of the plunger, thereby sealing the interior of the switch assembly. The boot has a flexible portion adjacent to the end of the plunger so that the plunger can be moved by pressing on the boot. This moves the magnet toward the reed switch to actuate the reed switch, and a spring biases the plunger and magnet away from the reed switch when pressure on the boot is relieved.

15 Claims, 3 Drawing Sheets

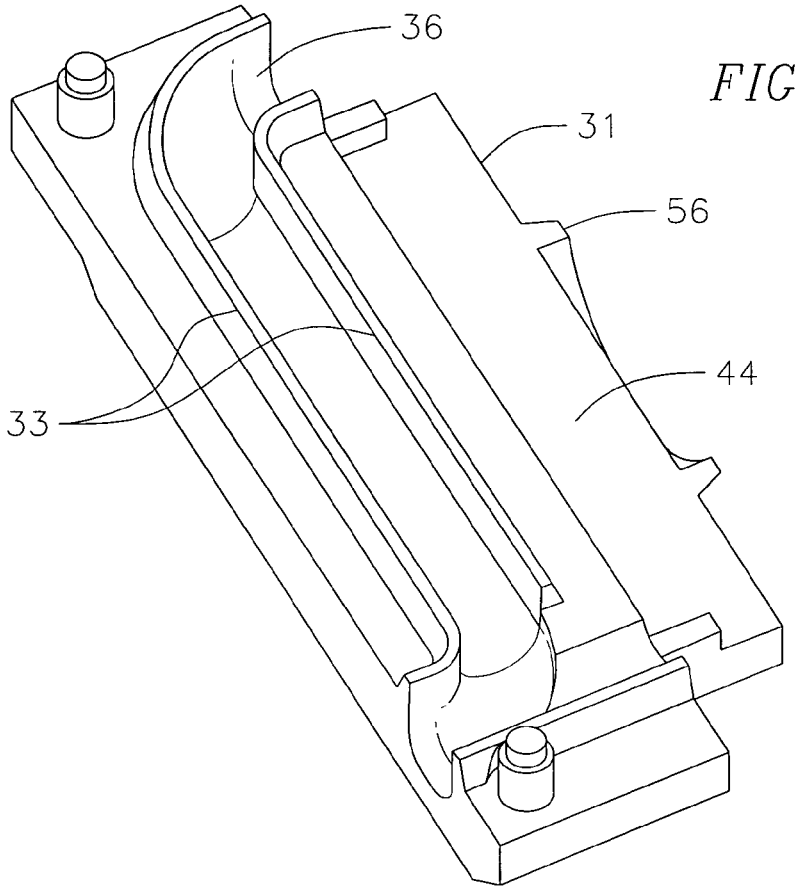
FIG. 3
FIG. 4
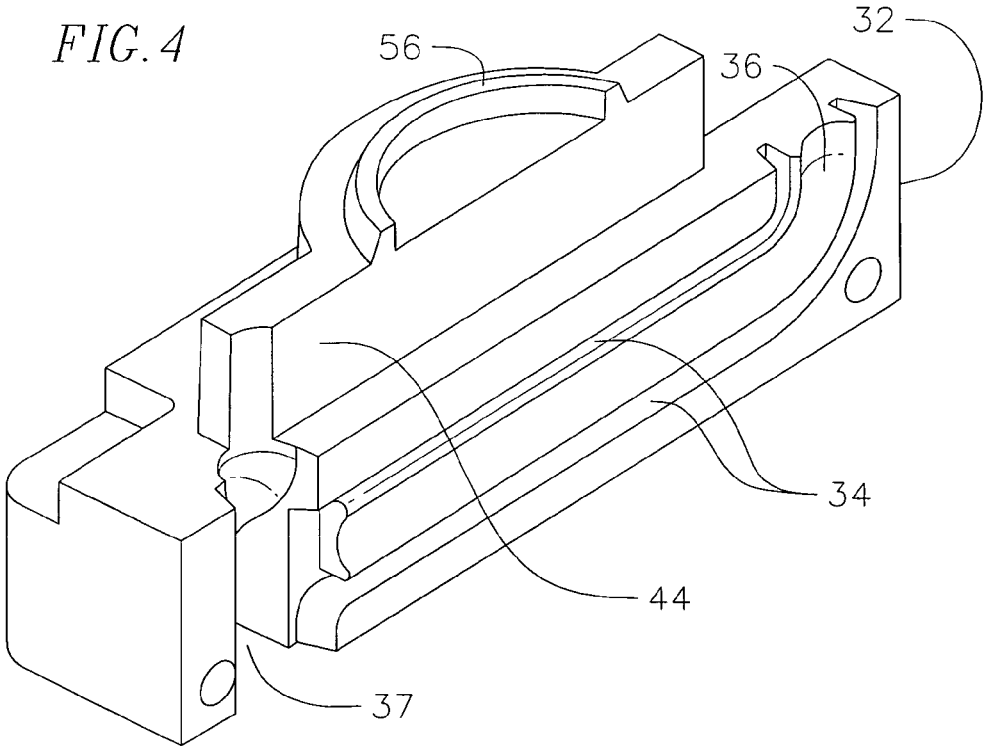

WATER RESISTANT SWITCH ASSEMBLY

CROSS-REFERENCE TO RELATED APPLICATION(S)

This application claims priority benefit of U.S. Provisional Application No. 60/651,586 filed Feb. 10, 2005.

BACKGROUND

A previous switch assembly currently used in the tailgate of a sport utility vehicle for raising and lowering a window sometimes receives enough moisture to fail. The switch is located under a plastic panel outside the vehicle which partially protects it from the weather and road splash. However, sometimes enough water enters the switch assembly to cause it to fail. The prior switch assembly employs a TACT (or tactile) switch element, which is essentially a miniature push button switch. It is desirable to prevent moisture from entering the switch assembly to prevent malfunctions.

To avoid the problem of moisture in the switch assembly, the present invention employs a reed switch. The new water resistant reed switch assembly is illustrated in the accompanying drawings and described hereinafter.

A reed switch is a hermetically sealed switch, typically employing one or two reeds as the ends of electrical leads passed through the ends of a glass tube. The tube is heated, softened, pressed onto the leads and hence sealed at both ends. The tube contains an inert gas, reducing gas or vacuum. At least one of the reeds sealed inside the glass tube is a ferromagnetic material. Such a switch is normally OPEN, and when a magnetic field is applied from outside the glass tube, the ferromagnetic reed is deflected and makes electrical contact with the other reed, thereby changing the switch to a CLOSED state. Such sealed reed switches are conventional and commercially available in a variety of sizes.

BRIEF SUMMARY OF THE INVENTION

A water resistant switch assembly has a sealed housing with a reed switch within the housing. A magnet adjacent to the reed switch actuates the reed switch. The reed switch is actuated by means for moving the magnet toward the reed switch in response to pressure applied outside the sealed housing, and means for moving the magnet away from the reed switch when outside pressure is relieved.

DRAWINGS

FIGS. 3 and 4 are details of two reed holder halves in a reed switch holder subassembly.

DESCRIPTION

Figure 1:
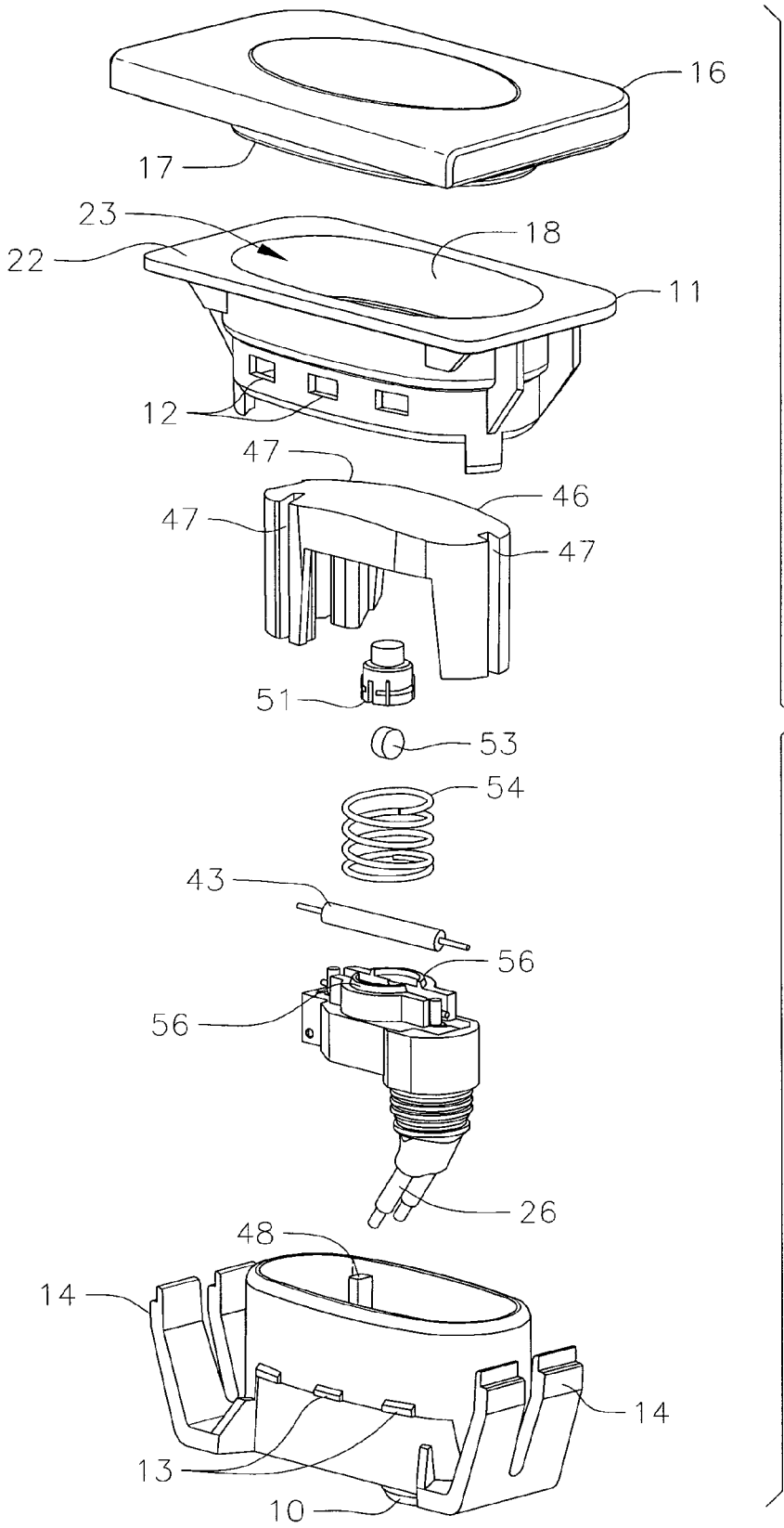
FIG. 1 is an exploded view of the parts used in the switch assembly.
Figure 2:
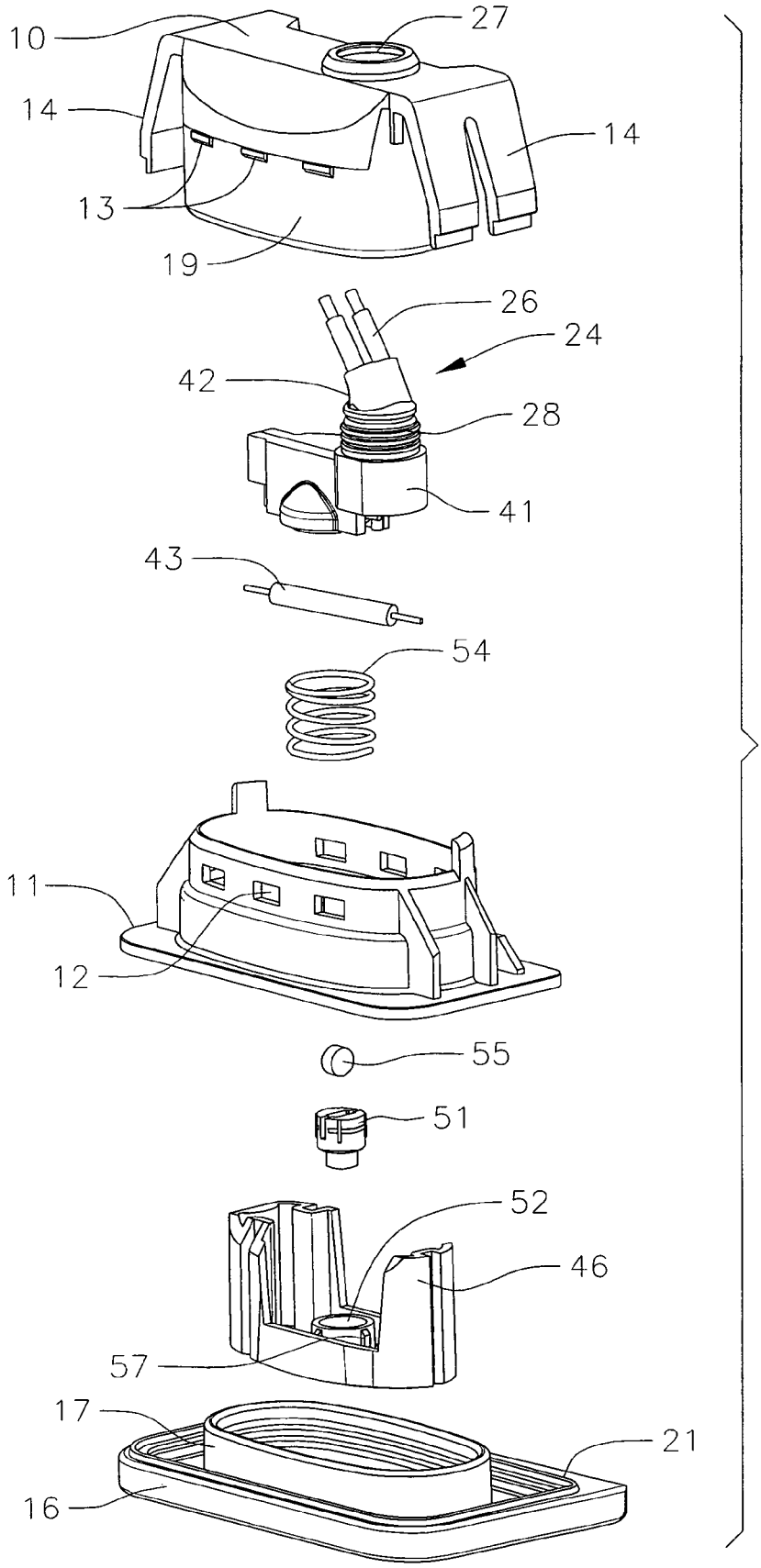
FIG. 2 is a similar exploded view with the parts shown at a different angle.

The water resistant switch assembly comprises a housing 10, which like most of the parts of the switch assembly is injection molded plastic. The open end of the housing is closed by a cover or bezel 11, a portion of which snaps over the outside of the housing. There are three openings 12 along each side of the cover. When the cover is snapped onto the housing it is retained by three raised detents 13 along each side of the housing which snap into the openings 12.

(It should be noted that in the U.S. Provisional Patent Application filed with respect to this invention, the housing 10 was called a "cover" and what is now called a cover 11 was called a "housing" in the Provisional Application. The change of name is a matter of convenience for description and does not imply any change of structure.)

As illustrated in the drawings, there are four legs 14 extending diagonally from the housing, which need no further description. These legs are on the outside of the switch assembly for securing the assembly into the tailgate of a specific SUV in which this embodiment of switch may be used. Other mounting arrangements or other embodiments for different vehicles may be employed as will be apparent to those skilled in the art. For example, there may simply be screw holes through some portion of the housing or cover, or notches may be formed to receive spring clips of the sort commonly known in the auto industry. These legs and other mounting means have no influence on operation of the switch assembly, the operable parts of which are inside the housing and cover.

The cover and housing are sealed against moisture at one end by an elastomeric boot 16. The boot has an oval flange 17 which fits into a recess 18 in the cover or bezel. The flange also fits around an outer portion 19 of the housing to form a seal between the cover and housing. A peripheral bead 21 is raised on the inner face of the boot and presses against the flat face of the cover or bezel when the switch is assembled. This provides a seal around the large central opening 23 through the cover.

A reed switch subassembly 24 has a pair of electrical leads or wires 26 which extend out of the housing when the switch is assembled. These wires pass through a circular opening 27 in the end of the housing and within the reed switch subassembly. The wires are illustrated schematically as stubs extending from the reed switch subassembly for convenience of illustration. It will be understood that the wires are of greater length sufficient for connecting to the electrical system of the SUV or the like in which the switch is used. The reed switch subassembly includes a ribbed elastomeric section 28 which is slightly larger than the circular hole through the housing for sealing the reed switch subassembly to the housing. Thus, there are seals for all possible leak paths through the housing and cover when assembled. The openings 12 through the sides of the cover are entirely outside the sealed portion of the switch assembly.

The reed switch subassembly is formed of three parts plus the two wires. For convenience, one injection molded part is referred to as a reed holder right 31 and the other part as a reed holder left 32 (left and right have no structural implications). The two reed holders fit together with male ridges 33 on the reed holder right fitting into mating grooves 34 in reed holder left. Between these mating parts there is a Z-shaped channel 36, on side of which is in reed holder right and side of which is in reed holder left. One of the electrical lead wires has two right angle bends to lie securely in the Z-shaped channel. The end of the wire extends beyond the end of the channel for connection to the reed switch. A second channel 37 primarily in reed holder left receives a straight wire for making electrical connection to the other end of the reed switch.

The reed switch subassembly is made by placing the two wires in the grooves 36 and 37 between reed holder left and reed holder right, and pressing the reed holder halves together. The grommet 28 of elastomeric material is then injection molded around the assembled reed holders. The grommet includes a body 41 integral with the ribbed section, partly encompassing the ends of reed holder left and reed holder right to help hold them in engagement around the wires. There is also a tapered stress relief section 42 surrounding the wires outside the housing.

After the grommet is formed, a reed switch 43 is placed between opposing faces 44 on reed holder left and reed holder right. The lead wires of the reed switch are then soldered to the ends of the wires embedded between the two reed holder halves. The reed switch subassembly can then be assembled into the housing with the external wires and ribbed grommet passing through the circular opening 27.

A plunger 46 fits into the housing for longitudinal movement toward or away from reed switch. Movement of the plunger is guided by grooves 47 which mate with corresponding ribs 48 in the housing (one of which can be seen in the drawings). A magnet holder 51 is pressed fitted into a recess 52 inside the plunger. The cylindrical magnet 53 is pressed fit into the plunger. Thus, there is a plunger subassembly which is effectively a plunger with a generally centrally located magnet.

A coil spring 54 has one end centered by raised circular rib 56 on the reed switch subassembly. The other end of the spring is around a boss 57 in the center of the plunger. The spring biases the plunger away from the reed switch subassembly and toward the elastomeric boot on the end of the switch assembly.

The boot has a flexible central oval area roughly corresponding to the shape of the plunger. The reed switch is operated by pressing on the flexible area of the boot to press the plunger toward the reed switch subassembly. The brings the magnet close enough to the reed switch to change the switch from its normally open state to a closed state. The reed switch opens again when pressure on the boot is relieved and the spring moves the plunger away from the reed switch subassembly. Thus, the entire operation of the switch occurs inside the sealed portion of the switch assembly so that moisture is excluded. Effectively, the flexible boot seals one end of the switch assembly and the grommet seals the other end.

An advantage of using a reed switch and movable magnet for actuating the reed switch is that moisture that may get past the seals into the switch assembly do not reach the electrical elements of the switch (which are sealed inside the glass tube of the reed switch). Corrosion and electrical shorting in the switch are avoided. There is minimized requirement for permanent perfect moisture seals.

In the illustrated embodiment, the oval area is slightly domed, but that is only a characteristic of the specific embodiment. Likewise, the plunger and flexible area of the boot are oval, and that is also for a specific embodiment for a specific model of SUV. The reed switch subassembly is made from two mating "halves" secured together by the grommet. If desired, such a subassembly could be made by injection molding the entire subassembly around suitably positioned wires, in either one or two injection molding steps. A suitable magnet might also be placed in a mold and the plunger injection molded around it, instead of press fitting the magnet into a separately manufactured plunger piece.

Instead of a plunger, a magnet may be mounted on a flexible member in the housing to be bent toward or away from the reed switch. Such a flexible member could be in the form of a cantilever that serves as its own return spring for moving the magnet away from the reed switch when pressure from outside the switch assembly is relieved. A magnet could be secured directly to or effectively be integral with a flexible portion of a sealing member like the boot to be moved relative to the reed switch. Such an elastomeric sealing member could be sufficiently stiff to be its own return spring. Other ways of securing the housing and cover together in an embodiment similar to that illustrated, and other variations in the switch assembly will also be apparent to those skilled in the art.

What is claimed is:

1. A water resistant switch assembly comprising:

a sealed housing;

a reed switch within the housing including a first switch terminal and a second switch terminal;

a magnet adjacent to the reed switch for actuating the reed switch;

means for moving the magnet toward the reed switch in response to pressure applied outside the sealed housing; and means for moving the magnet away from the reed switch when outside pressure is relieved, wherein the reed switch is coupled to a reed switch subassembly and electrical wires disposed within the reed switch subassembly, and the reed switch subassembly includes a first portion and a second portion that form curved channels for the electrical wires.

2. The water resistant switch assembly according to claim 1, wherein the means for moving the magnet comprises a plunger movable within the housing.

3. The water resistant switch assembly according to claim 1, wherein the means for moving the magnet comprises an elastomeric member sealing space around a plunger and sufficiently flexible for moving the plunger when pressed from outside the switch assembly.

4. The water resistant switch assembly according to claim 3, wherein the means for moving the magnet away from the reed switch comprises a spring within the housing.

5. The water resistant switch assembly according to claim 1, wherein the means for moving the magnet toward the reed switch comprises an elastomeric member sufficiently flexible for moving the magnet when pressed from outside the switch assembly.

6. A water resistant switch assembly comprising:

a housing;

a cover on the housing;

a plunger mounted for longitudinal movement in the housing;

a reed switch including wire terminals disposed in the housing and coupled to electrical wires extending out of the housing;

a magnet connected to the plunger adjacent to the reed switch; and an elastomeric boot closing an opening adjacent to an end of the plunger, the boot including a flexible portion adjacent to an end of the plunger, wherein the electrical wires are disposed in channels formed in a reed switch subassembly.

7. The water resistant switch assembly according to claim 6, further comprising an elastomeric moisture seal coupled through a portion of the housing where the electrical wires extend out of the housing.

8. The water resistant switch assembly according to claim 6, wherein longitudinal movement of the plunger moves the magnet closer to the reed switch in one direction and further away from the reed switch in the opposite direction.

9. The water resistant switch assembly according to claim 6, further comprising a right reed holder coupled to a left reed holder collectively supporting the reed switch within the housing.

10. The water resistant switch assembly according to claim 6, further comprising a spring biasing the plunger away from the reed switch and toward the boot.

11. The water resistant switch assembly according to claim 6, wherein the boot includes a flange portion configured to fit within an opening in the cover and over an outer portion of the housing to form a seal.

12. The water resistant switch assembly according to claim 6, wherein an outer portion of the boot is coupled to the cover to form a moisture seal.

13. A water resistant switch assembly comprising:

a housing;

a cover on the housing;

a plunger subassembly including a magnet mounted for movement in the housing;

a reed switch adjacent to the magnet for actuation between an OPEN state and a CLOSED state; and an elastomeric member fitted through the cover sealing space around the plunger and sufficiently flexible for moving the plunger subassembly when pressed from outside the switch assembly, wherein the elastomeric member covers an outer portion of the housing to create a water resistant seal, the reed switch is coupled to a reed switch subassembly including electrical wires connected to the reed switch and extending out of the housing, and the reed switch subassembly includes an elastomeric seal around wires leading to outside the housing.

14. The water resistant switch assembly according to claim 13, wherein the elastomeric member includes a portion coupled to the cover.

15. The water resistant switch assembly according to claim 13, wherein the reed switch subassembly comprises two reed holder halves encompassing the electrical wires in channels formed when the two reed holder halves are coupled together.

* * * * *